United States Patent [19]

Tarui

[11] 4,353,944

[45] Oct. 12, 1982

[54] SHOE SCRAPER MAT

[76] Inventor: Hiroyuki Tarui, 9, Chikko 2-Chome, Wakayama-Shi, Wakayama-Ken, Japan

[21] Appl. No.: 146,543

[22] Filed: May 2, 1980

[30] Foreign Application Priority Data

Nov. 10, 1979 [JP] Japan ..... 54-156308[U]
Nov. 10, 1979 [JP] Japan ..... 54-156309[U]

[51] Int. Cl.[3] ..... A47L 23/22

[52] U.S. Cl. ..... 428/74; 428/78; 428/82; 428/83; 428/85; 428/192; 428/218; 15/217

[58] Field of Search ..... 428/74, 82, 85, 77–79, 428/192–194, 196, 197, 195, 81, 68, 83, 120, 218; 15/215, 216, 217, 161

[56] References Cited

U.S. PATENT DOCUMENTS 1,008,618 11/1911 Skowronski et al. ..... 15/216
3,278,967 10/1966 Hagerman ..... 15/215
3,696,459 10/1972 Kucera et al. ..... 15/217

FOREIGN PATENT DOCUMENTS 2601712 7/1977 Fed. Rep. of Germany ..... 15/215
421835 1/1935 United Kingdom ..... 15/215

*Primary Examiner*—George F. Lesmes
*Assistant Examiner*—Alexander S. Thomas
*Attorney, Agent, or Firm*—Blanchard, Flynn, Thiel, Boutell & Tanis

[57] ABSTRACT

A shoe scraper mat comprising a mat holder of a heavy-gage rubber having a bottom plate and surrounding walls extending upright along the perimeter of the bottom plate, thus defining a space enclosed by the walls and a mat body which is fitted detachably in the space and is a laminate material prepared by interlacing and cumulating stiff filaments in multi-layer in a sparse state and bonding them together, the upper level of the mat body being located lower than the height of the surrounding walls and the upper surrounding walls defining a rib configuration over the mat body.

Another mat holder has further a partition wall dividing the space into two compartments, in which a rough scraper mat body made of the laminate material and a finishing scraper mat body are fitted, respectively, thereby to provide two-stage type of a shoe scraper mat.

3 Claims, 6 Drawing Figures

SHOE SCRAPER MAT

This invention relates to shoe scraper mats whose shoe scraping parts are replaceable and easily washable and which have a good cushioning property and are capable of retaining scraped-off dirt, such as soil, dust, mud or slop, therein so as not to disperse it into the environment arounds the mats.

In general, a shoe scraper mat is required to have a good washability, compressive rebound elasticity and a good dirt scraping performance, but it should not cause displacement during use or disperse scrapped-off dirt into the environmental area.

Shoe scraper mats which have hitherto been used usually include, for example, a moulded plate mat made of rubber or plastics, and a mat that is constructed of a metal frame and palm fibers or plastics strips. The former has the drawbacks that it is difficult to completely scrape off the dirt attached to shoes with the mat because the fineness of the rugged surface made by the moulding process is relatively large, and it is inconvenient to handle it owing to its heavy weight. On the other hand, the latter is inferior in positional stability during use because of its light weight and it is unsuitable for washing and exhibits a poor cushioning property when trampled.

In view of the drawbacks inherent in the prior art shoe scraper mats, the inventor experimentally developed improved mat in which the mat body is formed by interlacing irregularly coiled or waved palm fiber or synthetic monofilamentary yarns in a multi-layer construction in a sparse state, adhesively bonding the interlacing points and pressing the structure into a required shape of an appropriate size and uniting it with a rubber plate of an appropriate thickness. This mat, however, has been found still to have problems after repeated trial productions and investigations. That is, it exhibits superior performances in respect of positional stability and compressive rebound elasticity, compared to those of conventional articles, but it still has difficulties in replaceability and washability and dirt attached to it dissipates around it.

Accordingly, this invention has, as a primary object, to provide a new shoe scraper mat by which the aforementioned good performances required for a shoe scraper mat can be achieved and the aforesaid drawbacks and problems can be overcome.

The shoe scraper mat according to this invention comprises a mat holder made of a heavy-gage rubber which includes a bottom plate of a desired shape and surrounding walls extending upright along the perimeter of the bottom plate; and a mat body which is mounted and fitted detachably in a space enclosed by the surrounding walls of the mat holder, the upper planar surface of the mat body when fitted being located in a lower position than the height of the surrounding walls of the mat holder, and the surrounding walls of said mat holder defining a rib configuration over the marginal portions of the mat body.

According to another embodiment of this invention, there is provided a two-stage scraping type of shoe scraper mat which comprises a mat holder having surrounding walls and constituting two compartments for holding two mat bodies in the space enclosed by the surrounding walls, and two mat bodies mounted and fitted in the compartments of the mat holder, one of which is a rough scraper mat body and the other of which is a finishing scraper mat body, the upper planar surfaces of said mat bodies when fitted in the mat holder being located lower than the height of the surrounding walls, and the surrounding walls of said holder defining a rib or ridge contour over the marginal portions of the mat bodies.

This invention will be described below in greater detail with reference to the accompanying drawings in which.

Figure 1:
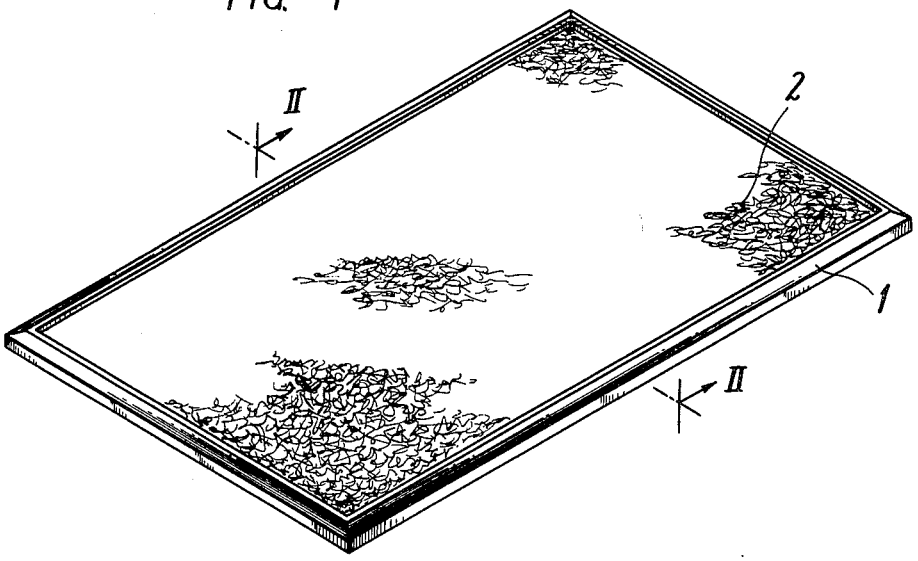
FIG. 1 is a schematic perspective view of one example of a shoe scraper mat according to this invention.
Figure 2:
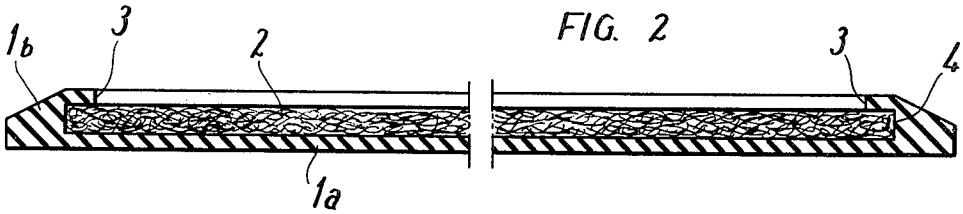
FIG. 2 is a cross-sectional view taken along the line II—II in FIG. 1.
Figure 3:
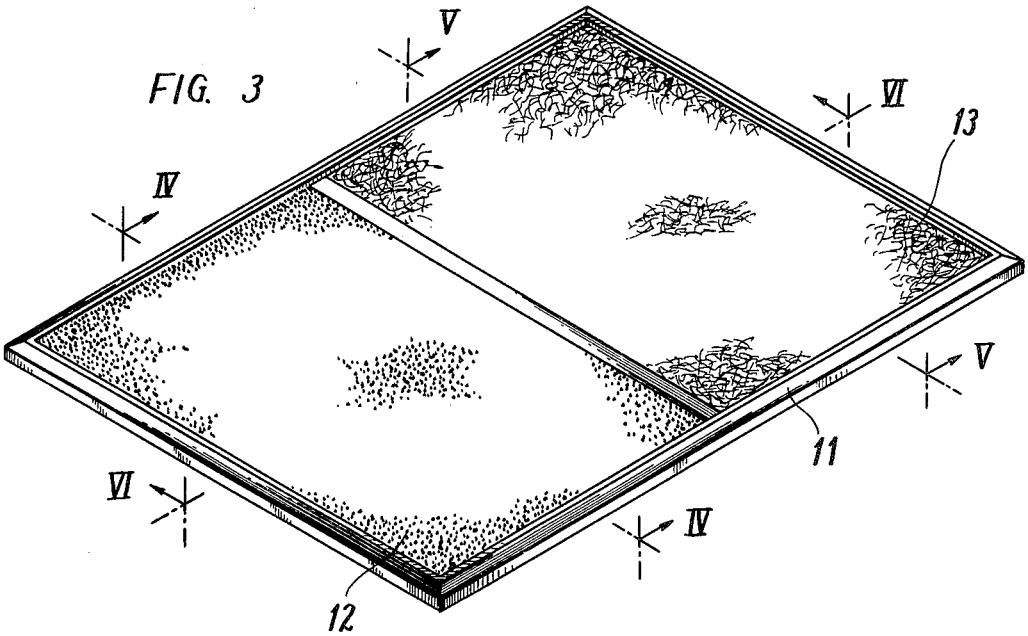
FIG. 3 is a schematic perspective view of another example of a shoe scraper mat according to this invention.
Figure 4:
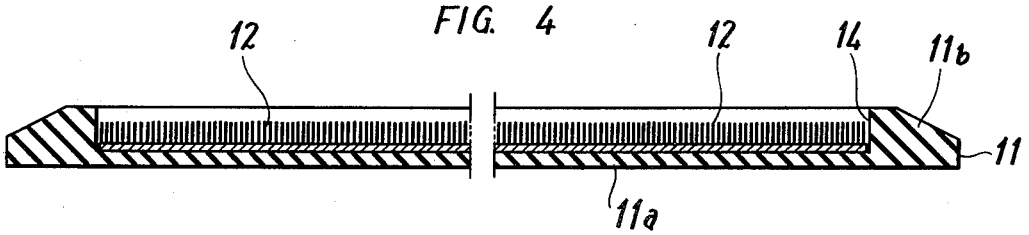
FIGS. 4, 5 and 6 are cross-sectional views taken along the lines IV—IV, V—V and VI—VI, respectively in FIG. 3.

Now referring to FIGS. 1 and 2, one example of a shoe scraper mat according to this invention is shown, in which the reference numeral (1) identifies a mat holder for mounting and fitting a mat body (2) of a required size therein.

The mat holder is made of a heavy-gauge synthetic or natural rubber having an adequate weight to afford a good positional stability and is formed with a bottom plate (1*a*) of a required shape conforming to the size of a mat body and surrounding walls (1*b*) which extend upwardly from the perimeter of the bottom plate (1*a*) and are adapted to enclose the mat body to be held within the mat holder.

In the mat holder (1), the surrounding walls (1*b*) and the bottom plate (1*a*) may be moulded and united together or the surrounding walls (1*b*) may be adhesively bonded to the perimeter of the bottom plate (1*a*). The surrounding walls (1*b*) are required to extend higher than the upper plane of the mat body (2) and accordingly, the mat body (2), when mounted and fitted into the mat holder (1) along the inner surrounding walls, is downwardly offset from the upper edge of the mat holder. This configuration serves to retain dirt, dust, mud, slop or the like attached to the upper surface of the mat body (2) within the mat holder (1) so as not to spread outside the mat holder.

The surrounding walls (1*b*) are defined by recessed or concave portions (3) around all the inner walls thereof to insure fitting of the marginal portions of the mat body (2) in the mat holder (1).

When the mat body (2) is mounted and fitted in the mat holder (1), the marginal portions of it are urged into the concave portions (3) along the internal surrounding walls of the mat holder.

The mat body (2) which is mounted and fitted in the mat holder is made of a laminate material. It is formed by interlacing or interlocking and cumulating one or more kinds of filaments having a stiffness, for example, synthetic fiber monofilaments such as nylon, polyester, polypropylene or the like, palm fiber or coconut palm fiber in a multi-layer construction, the constituent filaments assuming an irregular coiled or undulated form and being distributed sparsely, bonding the interlacing parts of the filaments and pressing the entirety of the filamentary structure thus obtained into a shape of a required size.

The constituent filaments to be used for the laminate materials are interlaced or interlocked and cumulated usually in an amount per area of about 200–800 g/m$^2$, preferably 300–500 g/m$^2$, to provide a relatively large void volume, namely, in a sparse state. The amount per area of the constituent filaments of a laminate may be chosen appropriately according to the place where the contemplated shoe scraper mat is to be used.

The interlacing parts are applied with an appropriate adhesive by means of a spraying or soaking treatment. Otherwise, where the constituent filaments are synthetic filaments, the interlacing parts may be bonded by hot melting. Further, bonding can be achieved in such a way that monofilaments and other filaments or fibers having different melting points are mixed together, and the filaments or the fibers of the lower melting point are melted by heating upon pressing or prior to pressing.

Then, the whole built-up structure is pressed into a shape under heating thereby to stabilize the shape of it, to impede the fraying of it and to impart wear resistance to it. The press moulding treatment serves to stabilize wholly the constituent filaments and to enhance the handling property as well as the appearance as an article.

According to another embodiment of the invention, there is also provided a shoe scraper mat which comprises a mat holder having surrounding walls and defining a space enclosed by the surrounding walls, which space is divided into two compartments and two mat bodies each mounted and fitted in the compartments, one being a rough scraper mat body and the other being a finishing scraper mat body, the upper level of said mat bodies when fitted being positioned lower than the upper edge of the surrounding walls of the mat holder, whereby a two-stage scraping system of shoe scraper mat is provided.

Referring to FIGS. 3, 4, 5 and 6, the reference numeral (11) identifies a mat holder for mounting and holding mat bodies of a required size therein which mat holder is made of a heavy-gage, natural or synthetic rubber and has an adequate weight to avoid displacement and enhance stability.

The mat holder (11) comprises a bottom plate **(11*a*) of a required shape, surrounding walls (11*b*) extending upwardly along the perimeter of the bottom plate which define a space for holding and enclosing mat bodies (12, 13) and a partition wall (11*c*) which is provided to divide the space enclosed by the surrounding walls into two compartments, in which the mat bodies (12, 13)** are mounted and fitted.

The surrounding walls **(11*b*) and the partition wall (11*c*) may be integrally molded together with the bottom plate (11*a*) or bonded together to the perimeter of the bottom plate (11*a*)**.

It is required that the height of the surrounding walls **(11*b*) be higher than that of the plane containing the upper surface of the mat bodies (12, 13)**.

The mat bodies (12, 13) are, accordingly, each held in a downwardly offset state within the mat holder (11) when mounted and fitted along the inner wall surfaces of the surrounding walls **(11*b*) of the mat holder, whereby the surrounding walls constitute rib or ridge portions (14) over the marginal portions of the mat bodies in the upper parts. These rib portions (14) serve to retain dirt, dust, mud, slop, soil, etc. attached on the upper surface of the mat bodies within the mat holder (11)** so that they may not get out.

On the other hand, the rib portions (14) are preferred to be as small as possible so as not to obstruct walking. Therefore, it is desirable to determine appropriately the size of the rib portions taking into consideration both the factors of dirt retention and easy walking. The configuration of the rib portions (14) may be rounded off along the inner edge to make walking easy.

The two mat bodies (12) and (13) are mounted and fitted in the respective compartments defined and partitioned by the surrounding walls **(11*b*) and the partition wall (11*c*), (12) being a finishing scraper mat body and (13) being a rough scraper mat body. The finishing scraper mat body (12) is a conventional carpet piece made of one or more kinds of natural fibers, regenerated cellulose fibers, or synthetic fibers. The rough scraper mat body (13) is of the same kind of laminate material as the laminate material (2) described above and is more coarse and stiff as compared with the carpet piece 12 and is prepared likewise as in the case of the laminate body (2) in FIG. 1**.

When the mat bodies (12) and (13) are mounted and fitted in the spaces enclosed by the surrounding walls **(11*b*) and the partition wall (11*c*), the upper plane of them is located lower than the upper edges of the surrounding walls (11*b*), and they are disposed together connectedly through the partition wall (11*c*)**, thereby to constitute two-stage scraping system of rough scraping and finishing scraping.

Figure 5:
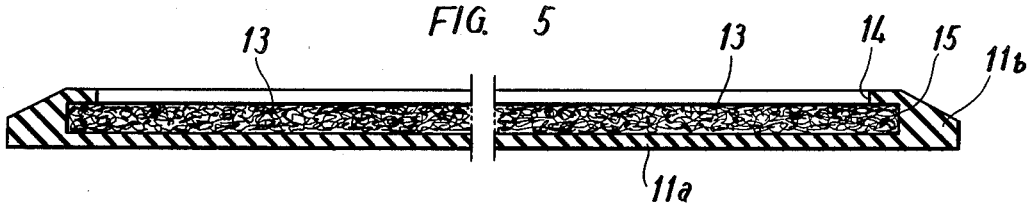
Figure 6:
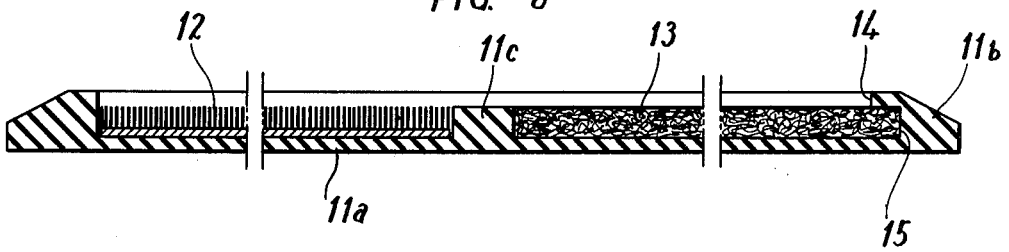

The carpet mat body (12) is mounted to be readily detachable along the inner vertical walls whereas the laminate mat body (13) is fitted in the concave portions (15) defined along the lower inner wall surfaces of the surrounding walls **(11*b*) to secure the terminal parts thereof to the mat holder, as shown in FIGS. 5 and 6. The laminate mat body (13) is, accordingly, fitted in the mat holder (11) in such a manner that the terminal parts thereof may be forced into the recessed or concave portions (15)**.

The mat holder (1, 11) serves to impart a cushioning property together with the mat body (2, 12, 13). As the mat holder, accordingly, a heavy-gage, soft rubber having a good compressive rebound resiliency is employed by choosing appropriately the thickness and weight of it according to the contemplated place where the shoe scraper mat is used. A synthetic resin plate having the same performances may also be employed.

In any embodiments, the mat holder (1, 11) may be in a square, rectangular or any desired shape. For example, for car mat use, the mat holder may be shaped in the form of a modified rectangle, in which the rectangle is cut off a triangle by the line linking two points midway in the two adjacent sides thereof, from where a pit is defined corresponding to the position of the accelerator pedal of a car.

The shoe scraper mat thus constructed in accordance with the invention, when placed at a required position for use, particularly the laminate mat body thereof, exhibits significantly good shoe sole scraping performance as compared with prior art mats made of a rubber, synthetic plastics, or metal commercially available, thus permitting it to remove even small dirt. The shoe scraper mat may also be placed so that the surrounding walls and the bottom plate are embedded in the ground.

Where the shoe scraper mat according to this invention is a two-stage scraper mat, it is placed in such a direction that shoes are first scraped with the rough scraper mat body (13). Thus, where the two-stage scraper mat is placed outside in front of a building, a substantial part of the dirt, dust, mud, slop, soil, etc. attached to shoes can be first removed with the rough scraper mat body (13) and then, the rest can be removed completely with the finishing scraper mat body (12).

The dirt, dust, mud, slop and the like attached on the laminate mat body (2, 13) and the carpet mat body (12) can be well retained within the mat holder (1, 11) and they are prevented from dispersing outside it owing to the surrounding walls (1*b*, 11*b*), thus being free from contaminating the environment.

When the mat bodies were soiled by use, they are removed from the mat holder to replace them with a new mat body or to wash them for reuse.

As described above, the shoe scraper mat according to the invention has the advantages that it has a preferable compressive rebound resiliency, namely, a cushioning property owing to the heavy-gage rubber and the mat body and it has a good scraping performance during use; the positional stability during use of it is secured owing to the adequate weight of the rubber; dirt, dust, mud, slop, soil, etc. attached to the mat body are prevented from dispersing by reason of the rib contour of the surrounding walls since the upper level of the mat body is lower than the height of the surrounding walls, so that the environment around it is not contaminated; in the two-stage scraper mat, the scraping performance is further enhanced. Further, the mat body is readily replaceable since it is detachably fitted in the mat holder and is easily washable.

The laminate mat body as described above, when walked on, makes a pleasant sound and gives a comfortable walking feeling, and the margins of it are not frayed since the perimeter of it is pressed with the surrounding walls of the mat holder.

What is claimed is:

1. A shoe scraper mat, comprising:

a mat holder having a bottom wall, integral side walls extending upwardly from the perimeter of said bottom wall and an integral partition wall extending upwardly from the central portion of said bottom wall so that said side walls and said partition wall define two shallow, mat-holding recesses, said mat bolder being made of heavy gauge soft rubber so that the mat holder has good positional stability and possesses compressive rebound elasticity;

a rough scraper mat body disposed in and substantially completely filling one of said recesses, said rough scraper mat body being a laminate of irregularly coiled, undulating, stiff filaments which are interlaced, interlocked and bonded with each other and are distributed sparsely in a multi-layer state to provide a relatively large void volume in said rough scraper mat body so that said rough scraper mat body is effective for scraping off and retaining dirt from shoes;

a finishing scraper mat body disposed in and substantially completely filling the other of said recesses, said finishing scraper mat body being made of a carpet piece with the upper surface of said finishing scraper mat body being downwardly offset from the upper edges of said side walls;

said side walls continuing with the same lateral width past both said mat bodies, the portions of said side walls adjacent the marginal edges of only said rough scraper mat body having along their inner surfaces laterally outwardly extending recessed portions which recessed portions snugly receive therein the marginal portions of only said rough scraper mat body, said recessed portions forming the upper edges of said side walls adjacent the marginal edges of only said rough scraper mat body as integral, inwardly projecting lips of the same soft rubber material, which lips overlie the marginal edge portions of the upper surface of said rough scraper body so that said rough scraper mat body is releasably retained by said soft rubber lips in said one recess, the upper surface of said rough scraper mat body being downwardly offset from the upper edges of said lips whereby to retain dirt within said rough scraper mat body, the filaments of said rough scraper mat body being entirely disposed below the lower surfaces of said lips, the top surfaces of of the lips being coplanar with the top surface of the portions of the side walls bounding said other recess;

the upper edge of said partition wall being downwardly offset from the upper edges of said side walls, both said mat bodies having substantially planar upper surfaces which are substantially coplanar with each other and with the upper edge of said partition wall and with the underside of said lips, the recessed portions of the side wall extending from one end of said partition around the periphery of said one recess to the other end of said partition, but not beyond said partition ends or into the other recess.

2. A shoe scraper mat as claimed in claim 1 in which the amount of said filaments, per unit area, is in the range of from about 200 to 800 $g/m^2$.

3. A shoe scraper mat as claimed in claim 1 in which said bottom wall is substantially flat, said lips are coplanar and extend substantially parallel with said bottom wall.

* * * * *

UNITED STATES PATENT AND TRADEMARK OFFICE

CERTIFICATE OF CORRECTION

PATENT NO. : 4 353 944

DATED : October 12, 1982

INVENTOR(S) : Hiroyuki Tarui

It is certified that error appears in the above—identified patent and that said Letters Patent is hereby corrected as shown below:

Column 5, line 41; "mat bolder" should read ---mat holder---.

Column 6, line 30; change "of of" to ---of---.

Signed and Sealed this

First Day of March 1983

[SEAL]

*Attest:*

GERALD J. MOSSINGHOFF

*Attesting Officer*

*Commissioner of Patents and Trademarks*